US005611384A

United States Patent [19]

Carter

[11] Patent Number: 5,611,384

[45] Date of Patent: Mar. 18, 1997

[54] DISPLAY SYSTEM

[76] Inventor: Wallace T. Carter, 118 Holiday Hills Dr., Wilmington, N.C. 28409

[21] Appl. No.: 520,177

[22] Filed: Aug. 28, 1995

[51] Int. Cl.[6] ..... A47G 5/00

[52] U.S. Cl. ..... 160/135; 52/282.1; 52/726.3; 52/781; 52/DIG. 4; 52/DIG. 13

[58] Field of Search ..... 160/135, 352, 160/351; 52/761, 781, 780, 775, 282.1, DIG. 4, DIG. 13, 726.1, 726.3; 40/605, 606, 610

[56] References Cited

U.S. PATENT DOCUMENTS

| | | | |
|---|---|---|---|
| 2,044,422 | 2/1936 | Davidson . | |
| 2,193,469 | 1/1939 | Ashton . | |
| 2,266,854 | 4/1941 | Davis . | |
| 2,324,398 | 4/1941 | Kahr . | |
| 2,577,667 | 1/1950 | Waite . | |
| 3,571,999 | 3/1971 | Downing . | |
| 3,798,867 | 3/1974 | Starling . | |
| 3,913,656 | 10/1975 | Guyer | 160/135 |
| 3,928,930 | 12/1975 | Attwood . | |
| 4,531,564 | 7/1985 | Hanna | 160/351 |
| 4,606,167 | 8/1986 | Thorne . | |
| 4,711,046 | 12/1987 | Herrgord | 160/135 X |
| 4,865,111 | 9/1989 | Perutz . | |
| 4,979,554 | 12/1990 | Nelson . | |
| 5,067,547 | 11/1991 | Movrich . | |
| 5,150,554 | 9/1992 | Quinlan, Jr. et al. . | |
| 5,388,382 | 2/1995 | Brooks | 160/135 X |
| 5,439,043 | 8/1995 | Carter | 160/135 |

*Primary Examiner*—David M. Purol
*Attorney, Agent, or Firm*—Diller, Ramik & Wight, PC

[57] ABSTRACT

A portable display includes a center display panel and opposite side tubular end panels or columns. Each column has opposite side edge portions which carry tubular polygonal reinforcing members which in turn carry magnetically attractable strips which hold the columns in a tubular configuration with the side edge portions in overlapped relationship. A generally U-shaped member which is secured along an unexposed surface of each column secures each column to the central display panel. When the central display panel and the opposite end columns are made of the same material or covered with the same material, a line of demarcation between the columns and the central panel is essentially invisible which renders a virtually unbroken aesthetic appearance to the overall portable display.

24 Claims, 3 Drawing Sheets

10
15
17
18
18
13
19
23
26
25
18
24
22
27
20
27
11
27
80
21
20
21
81
18
17
18
80
27
19
81
21
14
25
24
26
27
18
23
22
12
20
30
30
27
20
30

10
11
12
13
14
15
16
17
18
19
20
21
22
23
24
25
26
27
29
30
73
5
6

DISPLAY SYSTEM

BACKGROUND OF THE INVENTION

The invention is directed to a display system which is portable, free standing and can be readily erected, knocked-down, packed, transported, unpacked and/or repacked for display purposes at sales presentations, press conferences, conventions, seminars and the like. The display system of the present invention is designed to provide a relatively large display surface without sacrificing portability, and doing so through the utilization of stately columns and contemporary curves which provide an aesthetically attractive three dimensional presence, yet having the flexibility of being easily reconfigured into smaller or larger free standing displays or table top displays. The display system includes at least two columns spanned by a display panel, although for larger displays at least two columns or tubular end panels are stacked upon each other to form a single stacked column at opposite sides of the display with at least two stacked display panels therebetween.

The tubular end panels or columns of the present display system avoid the generally complexities of many conventional display systems, structurally improve the performance of the display system and particularly allow the display system to be readily set-up and knocked-down with a minimum of effort and in the absence of any tools whatsoever.

A display system over which the present display system constitutes an unobvious improvement is that disclosed in U.S. patent application Ser. No. 08/148,617 filed on Nov. 8, 1993 in the name of Wallace Thomas Carter which granted on Aug. 8, 1995 under U.S. Pat. No. 5,439,043. The latter display system includes at least one display panel and a column or tubular end panel secured to each side edge of the display panel with each column being formed from a sheet of resilient material having opposite edges disposed contiguous each other to thereby impart a generally hollow configuration to each column. A generally hollow tubular elongated member is secured to each opposite edge of the sheet and to a portion of the sheet approximately midway between the sheet opposite edges. When the sheet is disposed with its edges contiguous to each other, two of the tubular elongated members are adjacent each other and the third tubular elongated member is generally diametrically opposite thereto. The adjacent or contiguous tubular elongated members are secured to each other by, for example, magnetic strips and/or plastic spring clips and another generally U-shaped elongated member is secured to one of the sheet edges for securing each column to an associated edge of an associated display panel. In this fashion two relatively flat sheets of resilient material can be each formed into a column with each column being then secured to opposite vertical edges of a central display panel thereby forming a relatively aesthetic system. However, in each column the opposite contiguous side edges are in edge-to-edge substantially abutting relationship which necessarily places the U-shaped elongated member exteriorly of each column. Therefore, rather than the surfaces of the columns and the central panels appearing as a single unbroken continuous surface, the exposed U-shaped elongated members are visible and detract from the overall aesthetic appearance of the display system. The latter is emphasized if, as is often the case, the U-shaped elongated members are constructed from different material and different colored material than the material and color or colors of the columns and/or the display panels associated therewith. Therefore, while the display system of the latter-identified patent is far more aesthetically attractive than heretofore provided, improvements thereover are highly desirable, particularly in the competitive and cost conscious environment of portable displays.

SUMMARY OF THE INVENTION

The novel display system of the present invention is similar to that disclosed in the latter-identified patent in that it includes at least one display panel and a column at each edge secured to the display panel with each column being formed from a sheet of resilient material having opposite edges. However, the opposite edges are not disposed in contiguous edge-to-edge abutting relationship, but are instead secured in substantially overlapped relationship to each other. It is along an inner unexposed surface of one of the overlapped edges that the U-shaped elongated member is secured and slidably receives therein an edge of a central panel. Since the forward facing or display side of each column is covered by a sheet of material which corresponds in texture and color to that of the central display panel or panels, once the central panel(s) is edge-united to the U-shaped elongated member of each column the display side or front-facing side of the overall display is essentially unbroken, and more importantly the U-shaped elongated members are hidden from sight. Thus, the display system or portable display of the present invention is decidedly more appealing than that of the noted patent.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 2, is an enlarged fragmentary cross sectional view taken generally along line 6—6 of FIG. 2 and illustrates an insert housed in opposing slots of the upper and lower display panels for maintaining the same in aligned stacked relationship with each other.

DESCRIPTION OF THE PREFERRED EMBODIMENT

Figure 1:
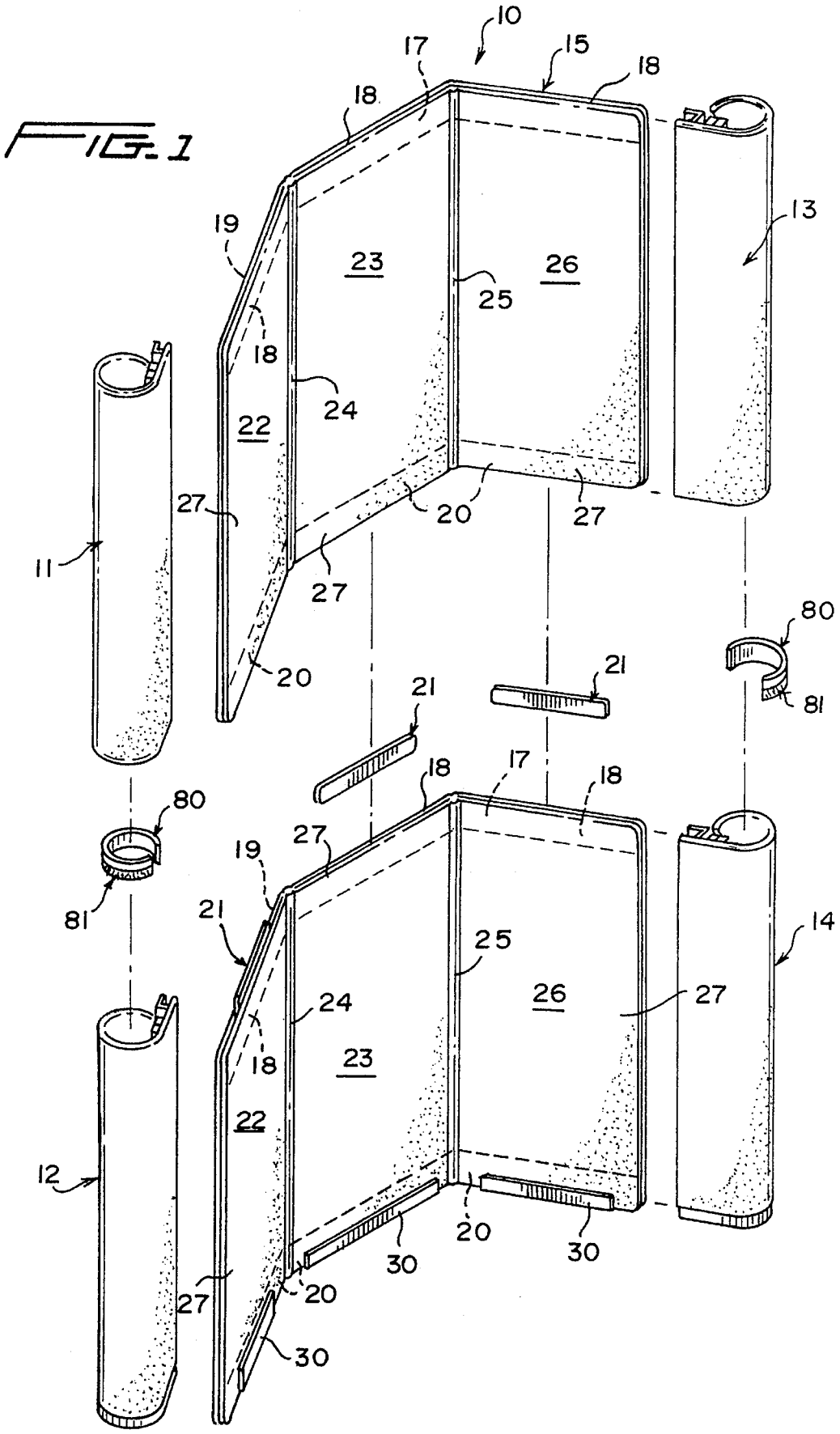
FIG. 1 is a perspective exploded view of a display panel of the present invention prior to assembly, and illustrates upper and lower three-panel display panels, elongated strips for uniting the upper and lower display panels in vertically aligned stacked relationship and superimposed pairs of tubular end panels or columns which are axially stacked and assembled and united to an associated display panel by means of a U-shaped elongated member which is hidden when the display panel is viewed from the front or display side thereof.
Figures 2, 6:
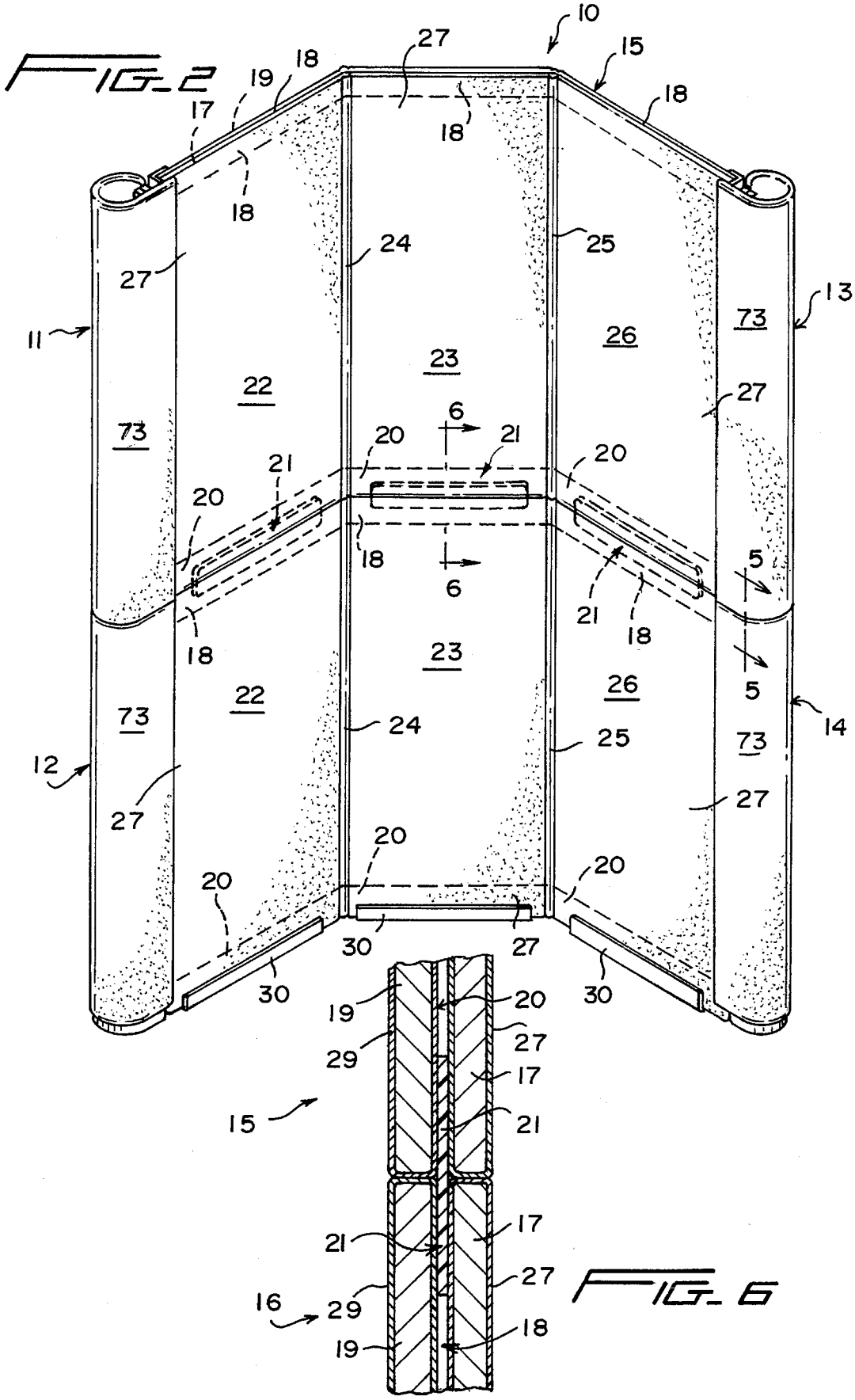
FIG. 2 is a perspective view of the display system or portable display of FIG. 1, and illustrates the same in assembled relationship.
FIG. 6, which appears on the sheet of drawing containing

A novel display system or portable display constructed in accordance with this invention is illustrated in FIGS. 1 and 2 of the drawings and is generally designated by the reference numeral 10.

The display system 10 includes four identical columns 11, 12, 13 and 14 with each column or tubular end panel being of a generally cylindrical configuration. As is apparent from FIG. 1, the columns 11 and 12 are intended to be stacked relative to each other in axially aligned relationship, as are the columns 13 and 14 and the final stacked and assembled relationship thereof is shown in FIG. 2.

Upper and lower foldable panel displays or display panels 15, 16, respectively, are each of a conventional construction and are each preferably constructed from a relatively stiff front sheet of material 17 (FIGS. 1, 2 and 6) bonded to a relatively stiff rear sheet 19 along the abutting planar surfaces (unnumbered) therebetween except for upper and lower edge portions which are free of adhesive and define an upper upwardly opening slot 18 and a lower downwardly opening slot 20 between the sheets 17, 19 of the respective upper and lower display panels 15, 16, respectively. Relatively elongated stiff plastic strips 21 are inserted halfway into each of the opposing pairs of slots 18, 20 of the respective lower and upper display panels 14, 15, as is best illustrated in FIGS. 1, 2 and 6 which function to retain the display panels 15, 16 in stacked, assembled relationship (FIG. 2).

Preferably the front and rear surfaces (unnumbered) of the front and rear sheets 17, 19, respectively, are each covered by relatively thin sheets 27, 29, respectively, of cloth which has an aesthetic appearance. Each of the upper and lower display panels 15, 16, respectively, include generally parallel fold lines 24, 25 which partially define with opposite side edges (unnumbered) of the display panels 15, 16, a central panel portion 23 and opposite side panel portions 22 and 26. A generally upwardly opening U-shaped channel or foot 30 receives a lower edge (unnumbered) of each of the panel portions 22, 23 and 26.

Figure 3:
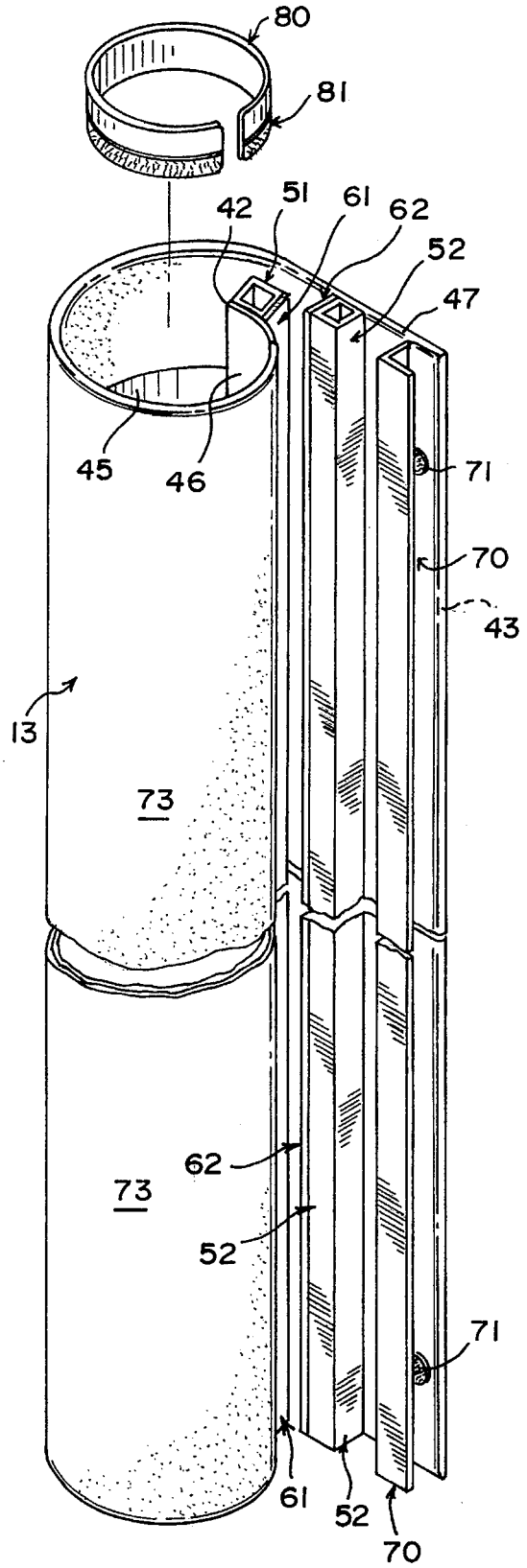
FIG. 3 is an enlarged fragmentary perspective view of one of the tubular end panels or columns of FIGS. 1 and 2, and illustrates first and second magnetically attractive securing means for retaining the column in its tubular configuration with side edge portions thereof in overlapped relationship, and one of the side edge portions carries a U-shaped elongated member or channel.

Reference is particularly made to FIG. 3 of the drawings which illustrates the tubular end panel or column 13 which is constructed from a sheet of relatively resilient material, preferably plastic, which is designated by the reference numeral 40. The sheet 40 is generally of a polygonal, rectangular or square configuration, depending upon the size and configuration of the column 13 desired, and is defined by an upper edge 41, a lower edge 39 (FIG. 5) parallel to the upper edge 41, a side edge 42 and an opposite side edge 43 parallel thereto. The plastic sheet 40 includes a first outer surface or face 44 (FIG. 4) and a second inner surface or face 45 (FIG. 3). The side edge 42 defines the free edge of a first side edge portion 46 of the sheet 40 while the side edge 43 defines a second side edge portion 47 of the sheet 40.

First and second reinforcing means 51, 52, respectively, are bonded or otherwise secured to the respective first and second side edge portions 46, 47 at the respective outer and inner surfaces 44, 45. The reinforcing means 51, 52 are aluminum tubes of a generally rectangular transverse cross sectional configuration which are disposed in generally parallel relationship to each other and extend substantially between the upper edge 41 and the lower edge 39 of the sheet 40.

Figure 4:
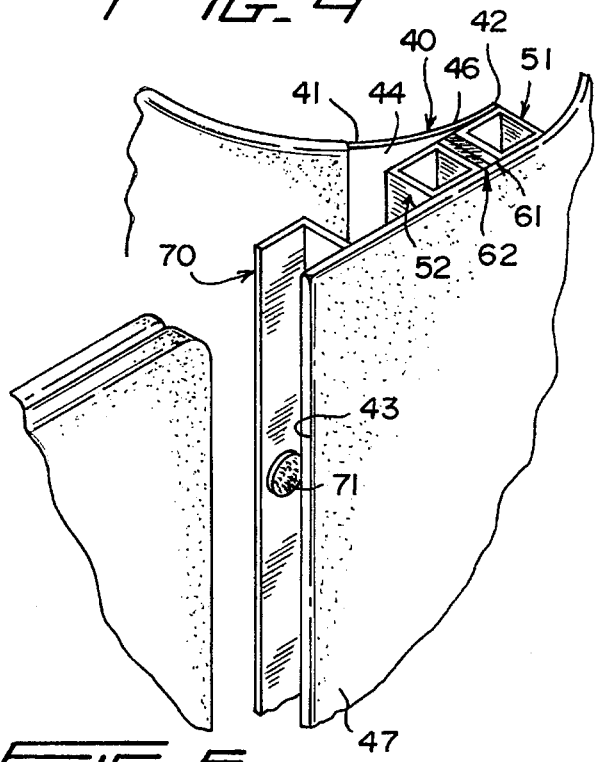
FIG. 4 is a fragmentary perspective view of a corner of one of the columns in the tubular assembled relationship thereof, and illustrates a central panel aligned for insertion in the U-shaped elongated member or channel.

The reinforcing means 51, 52 carry respective first and second securing means 61, 62 in the form of magnetically attractable strips of material which will hold the two tubes 51, 52 in intimate side-by-side generally parallel relationship, as shown in FIG. 4, to maintain the sheet 40 in its tubular or column-like configuration (see FIGS. 1 and 2). As is best illustrated in FIGS. 2 and 4, the first side edge portion 46 and the second side edge portion 47 are thereby held in overlapped relationship to each other with the second side edge portion 47 projecting generally toward the side edge (unnumbered) of the panel portion 26 of the upper display panel 15. This brings the second side edge portion 47 of all four tubular end panels or columns 11 through 14 into smooth generally unbroken merger with the side edges (unnumbered) of the respective display panels 15, 16 and in doing so maintain hidden a U-shaped clamping or securing member or channel 70 bonded or otherwise secured to the inner face or surface 45 of each sheet 40 immediately adjacent its side edge 43 and opening generally tangentially outwardly from each column 11–14 and toward the side edge (unnumbered) of the associated side panel portions 22, 26, of the upper and lower display panels 15, 16 whose edges are slidably received and clampingly held therein by the natural resilience of the channels 50. The gripping can be augmented by adhering disks 71 to inner and/or outer legs (unnumbered) of the channel 70. The disks 71 have an exterior surface (unnumbered) which has a high coefficient of friction and thereby tightly grip the cloth sheets 27, 29 of the display panels 15 and 16 which preferably include an outer face or surface defined by a thin piece of cloth 73 corresponding in texture and color to the cloth 27, 29 of the upper and lower display panels 15, 16, respectively. Thus, when the edges (unnumbered) of the side panel portions 22 and 26 (FIG. 2) are received in the U-shaped channels 70 the transition between the side panel portions 22, 26 and the columns 11–14 is barely visible and has been exaggerated in FIG. 2 for purposes of disclosure and description only.

Figure 5:
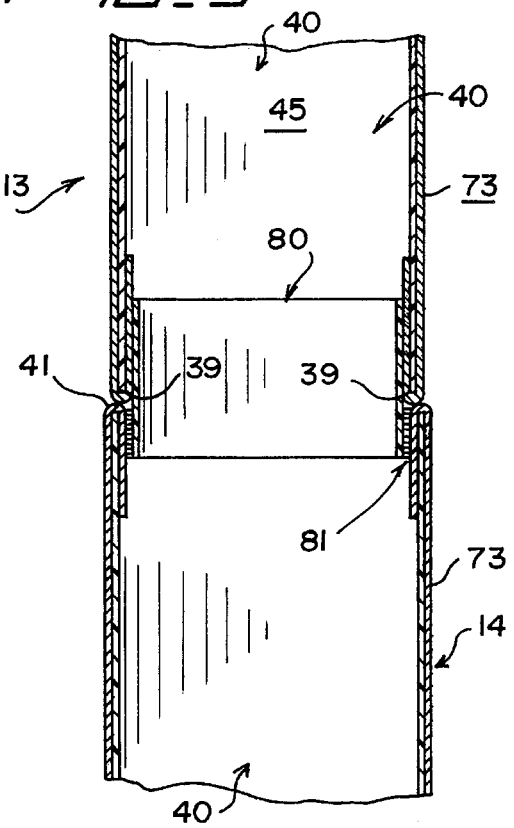
FIG. 5 is a fragmentary cross sectional view taken generally along line 5—5 of FIG. 2 and illustrates a tubular insert within a pair of stacked tubular end panels for maintaining the same in assembled stacked relationship.

The columns 11, 12 and 13, 14 are maintained in axially aligned stacked relationship by means 80 (FIG. 1) in the form of a relatively flat resilient plastic member carrying fastening means in the form of a strip of hooked and/or looped tape 81 (Velcro®) along one of the edges thereof. Each member 80 is normally uniplanar and can be formed into a relatively tight ring with the ends (unnumbered) thereof in overlapped relationship. When thus formed the now annular resilient members 80 can be inserted into the lowermost columns 12, 14 and the hooked or looped tape 81 will adhere to inner overfolded portions of the cloth 43, as is most apparent from FIGS. 3 and 5 of the drawings. The upper columns 13, 14 are then merely slid downwardly over the upper portions of the annular members 80, as is shown in FIG. 5 and in the latter configuration the now annular resilient members 80 maintain the axially stacked relationship of the columns 11, 12 and 13, 14. The final assembly of the portable display 10 appears generally as shown in FIG. 2, although it is again emphasized that the lines of merger between the columns 11–14 and side panels 22, 26 are far less apparent than in FIG. 2.

The display 10 of FIG. 2 is not only relatively easily set-up, but obviously the reverse procedure just described quickly allows the display 10 to be knocked down, stacked flat, packaged and transported as necessary for successive usage.

Although a preferred embodiment of the invention has been specifically illustrated and described herein, it is to be understood that minor variations may be made in the apparatus without departing from the spirit and scope of the invention, as defined in the appended claims.

I claim:

1. A substantially tubular end panel adapted for utilization with an associated display panel comprising a sheet of resilient material defined by upper and lower edge portions and opposite side edge portions, first and second cooperative securing means for securing said side edge portions together in substantially overlapped relationship thereby transforming said sheet into a tubular end panel, said first securing means being disposed along a first of said side edge portions, and said second securing means being disposed inboard of a free edge of a second of said side edge portions.

2. The substantially tubular end panel as defined in claim 1 wherein at least one of said first and second securing means include magnetical attractive means for securing said side edge portions together through magnetic attraction.

3. The substantially tubular end panel as defined in claim 1 wherein said first and second cooperative securing means include respective first and second planar surfaces in intimate contacting relationship with each other.

4. The substantially tubular end panel as defined in claim 1 wherein said sheet includes first and second opposite faces, and said first and second cooperative securing means are located respectively at said first and second opposite faces.

5. The substantially tubular end panel as defined in claim 1 including means contiguous said second side edge portion free edge for securing said tubular end panel to an associated display panel.

6. The substantially tubular end panel as defined in claim 1 including channel means contiguous said second side edge portion free edge for securing said tubular end panel to an associated display panel.

7. The substantially tubular end panel as defined in claim 1 including channel means contiguous said second side edge portion free edge for securing said tubular end panel to an associated display panel, and said channel means opens in a direction away from said second securing means.

8. The substantially tubular end panel as defined in claim 1 wherein said first and second securing means are respective first and second magnetically attractive means for securing said side edge portions together.

9. The substantially tubular end panel as defined in claim 1 including first and second elongated reinforcing means disposed in generally parallel spaced relationship from each other and extending substantially between said upper and lower edge portions for reinforcing said tubular end panel, said first reinforcing means being disposed along said first side edge portion, and said second reinforcing means being disposed inboard of said second side edge portion free edge.

10. The substantially tubular end panel as defined in claim 1 including first and second elongated tubular reinforcing means disposed in generally parallel spaced relationship from each other and extending substantially between said upper and lower edge portions for reinforcing said tubular end panel, said first tubular reinforcing means being disposed along said first side edge portion, and said second tubular reinforcing means being disposed inboard of said second side edge portion free edge.

11. The substantially tubular end panel as defined in claim 1 wherein said sheet includes first and second opposite faces, and said first and second reinforcing means are located respectively at said first and second opposite faces.

12. The substantially tubular end panel as defined in claim 4 including means contiguous said second side edge portion free edge for securing said tubular end panel to an associated display panel.

13. The substantially tubular end panel as defined in claim 4 including channel means contiguous said second side edge portion free edge for securing said tubular end panel to an associated display panel.

14. The substantially tubular end panel as defined in claim 4 including channel means contiguous said second side edge portion free edge for securing said tubular end panel to an associated display panel, and said channel means opens in a direction away from said second securing means.

15. The substantially tubular end panel as defined in claim 4 including first and second elongated reinforcing means disposed in generally parallel spaced relationship from each other and extending substantially between said upper and lower edge portions for reinforcing said tubular end panel, said first reinforcing means being disposed along said first side edge portion, and said second reinforcing means being disposed inboard of said second side edge portion free edge.

16. The substantially tubular end panel as defined in claim 5 including first and second elongated reinforcing means disposed in generally parallel spaced relationship from each other and extending substantially between said upper and lower edge portions for reinforcing said tubular end panel, said first reinforcing means being disposed along said first side edge portion, and said second reinforcing means being disposed inboard of said second side edge portion free edge.

17. The substantially tubular end panel as defined in claim 9 wherein said first and second securing means are carried by said respective first and second reinforcing means.

18. The substantially tubular end panel as defined in claim 12 including first and second elongated reinforcing means disposed in generally parallel spaced relationship from each other and extending substantially between said upper and lower edge portions for reinforcing said tubular end panel, said first reinforcing means being disposed along said first side edge portion, and said second reinforcing means being disposed inboard of said second side edge portion free edge.

19. The substantially tubular end panel as defined in claim 18 wherein said first and second securing means are respective first and second magnetically attractive means for securing said side edge portions together.

20. A pair of vertically stacked tubular end panels adapted for utilization with a display panel comprising an upper tubular end panel stacked upon and in substantially axial alignment with a lower tubular end panel, and sleeve means in generally intimate internal relationship to internal surfaces of said tubular end panels and in axial spanning relationship to said tubular end panels for maintaining said tubular end panels in stacked relationship to each other.

21. The stacked tubular end panels as defined in claim 20 including means for securing said sleeve means to one of said tubular end panels.

22. The substantially tubular end panel as defined in claim 20 including hook and/or loop fastening means for securing said sleeve means to one of said tubular end panels.

23. The substantially tubular end panel as defined in claim 20 wherein an internal surface of at least one of said tubular end panels includes hook and/or loop fastening means, and hook and/or loop fastening means carried by said sleeve means and being in interlocked fastened relationship with said tubular end panel velcro-type fastening means.

24. The substantially tubular end panel as defined in claim 20 wherein said sleeve means is defined by a substantially uniplanar polygonal sheet of resilient material formed to a generally sleeve-like tubular configuration.

* * * * *